US006923677B2

(12) United States Patent
Hsu

(10) Patent No.: US 6,923,677 B2
(45) Date of Patent: Aug. 2, 2005

(54) SUSPENSION LAMP HAVING QUICK CONNECTION FUNCTION

(75) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 0 days.

(21) Appl. No.: 10/730,819

(22) Filed: Dec. 8, 2003

(65) Prior Publication Data

US 2005/0124213 A1 Jun. 9, 2005

(51) Int. Cl.[7] ..... H01R 13/66

(52) U.S. Cl. ..... 439/531; 439/76.1; 439/537; 439/576; 439/541; 362/405; 362/457

(58) Field of Search ..... 439/531, 537, 439/576, 76.1, 541; 362/404, 405, 406, 249, 362/457

(56) References Cited

U.S. PATENT DOCUMENTS 4,079,244 A * 3/1978 Bortoluzzi ..... 362/405
4,721,480 A * 1/1988 Yung ..... 439/537
5,385,482 A * 1/1995 Rottner ..... 439/409
6,565,240 B1 * 5/2003 Wu ..... 362/405
6,793,383 B2 * 9/2004 Wu ..... 362/405
6,840,651 B2 * 1/2005 Wu ..... 362/405

* cited by examiner

*Primary Examiner*—Tho D. Ta
(74) *Attorney, Agent, or Firm*—Alan D. Kamrath; Nikolai & Mersereau, P.A.

(57) ABSTRACT

A suspension lamp includes a switch box, a wire connection base, a plurality of connecting terminals, and a plurality of electric wires. The wire connection base includes a support seat, a cap, a spacer, a first circuit board, a second circuit board, and a plurality of protective jackets. Thus, the operator only needs to mount each of the connecting terminals on a respective one of the protective jackets of the wire connection base so as to form an electrical connection state, so that the electric circuit of the suspension lamp is connected easily and conveniently, thereby facilitating the operator mounting the electric circuit of the suspension lamp.

11 Claims, 7 Drawing Sheets

PRIRO ART

SUSPENSION LAMP HAVING QUICK CONNECTION FUNCTION

BACKGROUND OF THE INVENTION

1. Field of the Invention

The present invention relates to a suspension lamp, and more particularly to a suspension lamp having a quick connection function.

2. Description of the Related Art

A conventional suspension lamp 1 in accordance with the prior art shown in FIG. 8 comprises a switch box 11 having a peripheral wall formed with a plurality of locking grooves 111, a plurality of bent support tubes 12 each mounted on the switch box 11 and each having an end formed with a connector 121 locked in a respective one of the locking grooves 111 of the switch box 11, an upper cover 14 mounted on an opened top of the switch box 11 and having a center formed with a through hole 141, a hollow threaded rod 13 mounted in the switch box 11 and having a first end extended through the through hole 141 of the upper cover 14 and a second end formed with a threaded section 131 formed with an opening 132, a nut 142 screwed on the first end of the threaded rod 13 and rested on the upper cover 14, a screw 15 extended through a closed bottom of the switch box 11 and screwed into the threaded section 131 of the threaded rod 13, and a nut 16 screwed on the screw 15 and rested on the bottom of the switch box 11. The conventional suspension lamp further comprises a power supply wire 17 extended through the threaded rod 13 and the opening 132, and a plurality of electric wires 18 each extended through a respective one of the support tubes 12 and each connected to the power supply wire 17.

However, the operator needs to separate the positive and negative poles of each of the electric wires 18 respectively, so that the positive and negative poles of each of the electric wires 18 are connected to the positive and negative poles of the power supply wire 17 respectively and are coated by a protective tape 19 to prevent occurrence of electrical leakage. Thus, the operator is located a higher position to separate the positive and negative poles of each of the electric wires 18 respectively so as to connect the positive and negative poles of each of the electric wires 18 with the positive and negative poles of the power supply wire 17 respectively and to coat the connected electric wires 18 by the protective tapes 19, thereby causing inconvenience and danger to the operator in assembly of the conventional suspension lamp.

SUMMARY OF THE INVENTION

The primary objective of the present invention is to provide a suspension lamp having a quick connection function.

Another objective of the present invention is to provide a suspension lamp having a better safety when the suspension lamp is assembled.

A further objective of the present invention is to provide a suspension lamp, wherein the operator only needs to mount each of the connecting terminals on a respective one of the protective jackets of the wire connection base so as to form an electrical connection state, so that the electric circuit of the suspension lamp is connected easily and conveniently, thereby facilitating the operator mounting the electric circuit of the suspension lamp.

In accordance with the present invention, there is provided a suspension lamp, comprising:

a switch box;

a wire connection base mounted in the switch box and including a support seat mounted on the switch box, a cap mounted on the support seat, a spacer mounted on the support seat and located between the support seat and the cap, a first circuit board mounted on a first side of the spacer and located between the spacer and the cap, a second circuit board mounted on a second side of the spacer and located between the spacer and the support seat, and a plurality of protective jackets each combined with the first circuit board and the second circuit board;

a plurality of connecting terminals each mounted on a respective one of the protective jackets of the wire connection base; and a plurality of electric wires each having an end attached to a respective one of the connecting terminals and each electrically connected to the first circuit board and the second circuit board through the respective connecting terminal and the respective protective jacket.

Further benefits and advantages of the present invention will become apparent after a careful reading of the detailed description with appropriate reference to the accompanying drawings.

DETAILED DESCRIPTION OF THE INVENTION

Figure 1:
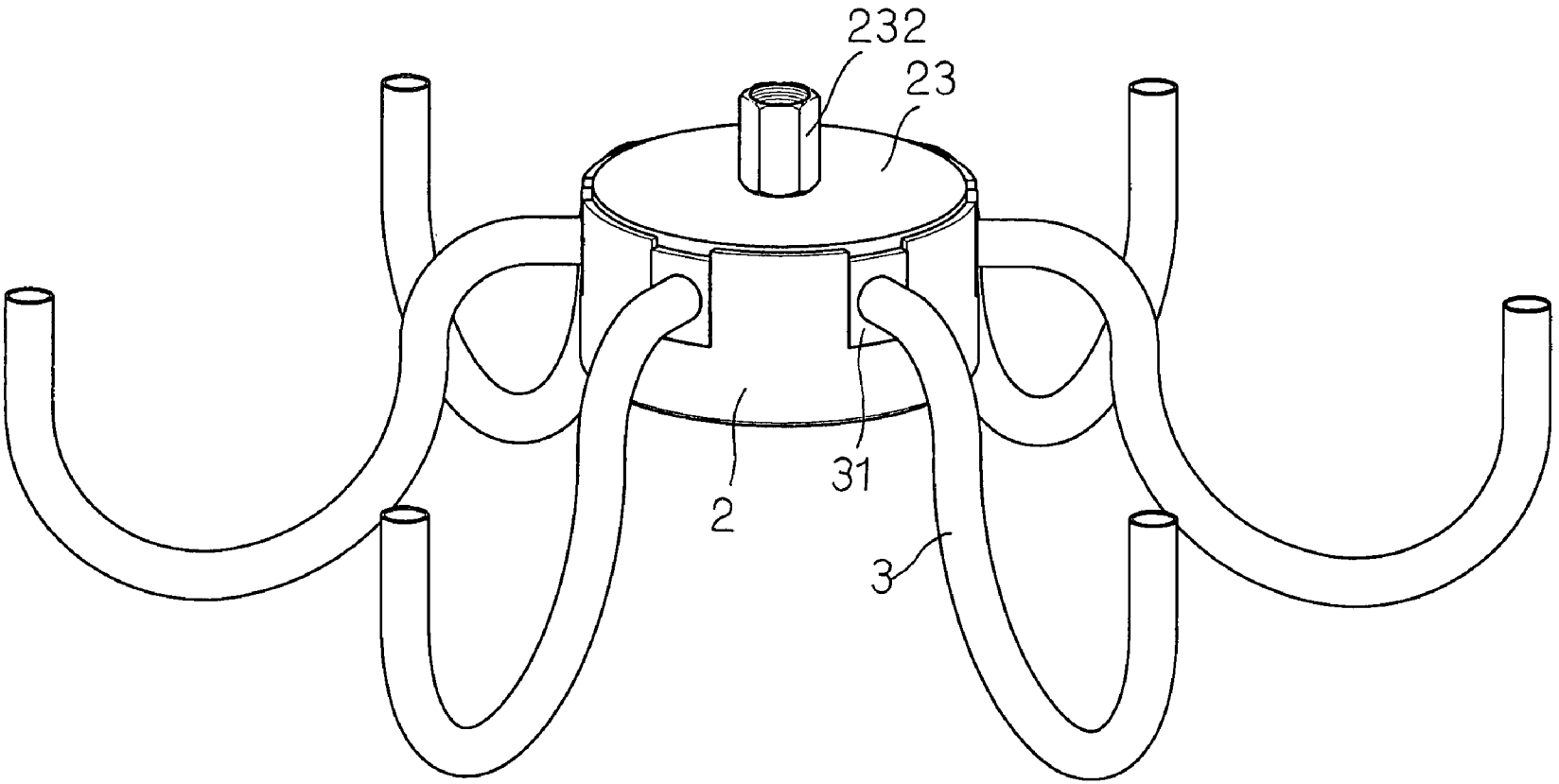
FIG. 1 is a perspective view of a suspension lamp in accordance with the preferred embodiment of the present invention.
Figure 2:
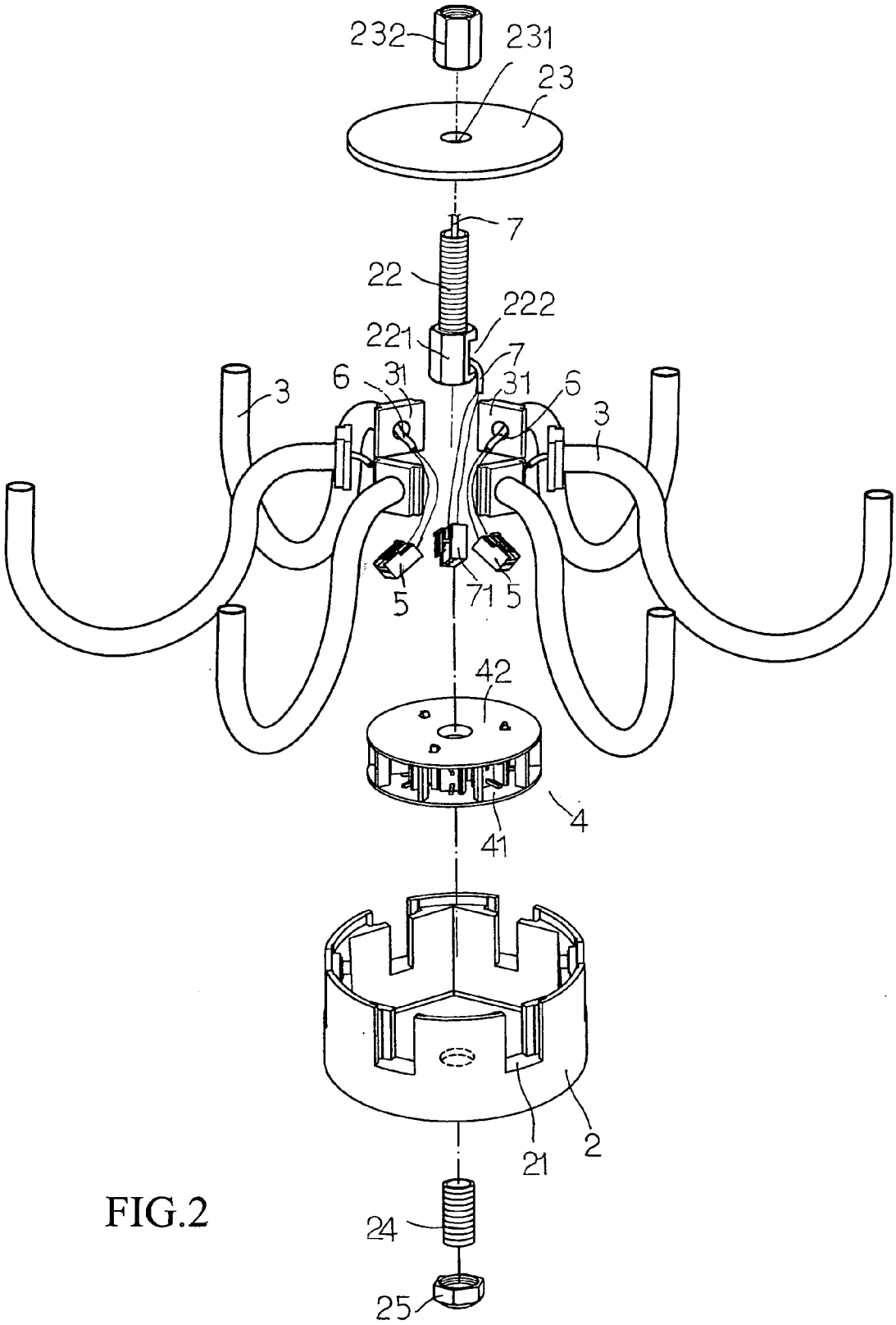
FIG. 2 is an exploded perspective view of the suspension lamp as shown in FIG. 1.

Referring to the drawings and initially to FIGS. 1–5, a suspension lamp in accordance with the preferred embodiment of the present invention comprises a switch box 2 having a peripheral wall formed with a plurality of locking grooves 21, a plurality of bent support tubes 3 each mounted on the switch box 2 and each having an end formed with a connector 31 locked in a respective one of the locking grooves 21 of the switch box 2, an upper cover 23 mounted on an opened top of the switch box 2 and having a center formed with a through hole 231, a hollow threaded rod 22 mounted in the switch box 2 and having a first end extended through the through hole 231 of the upper cover 23 and a second end formed with a threaded section 221 formed with an opening 222, a nut 232 screwed on the first end of the threaded rod 22 and rested on the upper cover 23, a screw 24 extended through a closed bottom of the switch box 2 and screwed into the threaded section 221 of the threaded rod 22, and a nut 25 screwed on the screw 24 and rested on the bottom of the switch box 2.

The suspension lamp further comprises a wire connection base 4, a plurality of connecting terminals 5, a plurality of electric wires 6, and a power supply wire 7.

The wire connection base 4 is mounted in the switch box 2 and includes a support seat 41 mounted on the bottom of the switch box 2, a cap 42 mounted on the support seat 41, a spacer 43 mounted on the support seat 41 and located between the support seat 41 and the cap 42, a first circuit board 44 mounted on a first side of the spacer 43 and located between the spacer 43 and the cap 42, a second circuit board 45 mounted on a second side of the spacer 43 and located between the spacer 43 and the support seat 41, and a plurality of protective jackets 46 each combined with the first circuit board 44 and the second circuit board 45.

The support seat 41 of the wire connection base 4 has a center formed with a passage hole 411 for passage of the threaded rod 22. The cap 42 of the wire connection base 4 has a center formed with a passage hole 422 for passage of the threaded rod 22. The support seat 41 of the wire connection base 4 has a periphery provided with a plurality of support posts 412 each rested on the cap 42.

The cap 42 of the wire connection base 4 is formed with a plurality of locking holes 421, and the support seat 41 of the wire connection base 4 is formed with a plurality of locking posts 413 each having an end formed with a locking hook 4310 locked in a respective one of the locking holes 421 of the cap 42, so that the cap 42 is combined with the support seat 41.

The first circuit board 44 of the wire connection base 4 has a periphery provided with a plurality of first conductive strips 441 electrically connected with each other. The second circuit board 45 of the wire connection base 4 has a periphery provided with a plurality of second conductive strips 451 electrically connected with each other.

Each of the protective jackets 46 of the wire connection base 4 has a first end mounted on a respective one of the first conductive strips 441 of the first circuit board 44 and formed with a first insertion hole 461 for insertion of the respective first conductive strip 441 of the first circuit board 44. Each of the protective jackets 46 of the wire connection base 4 has a second end mounted on a respective one of the second conductive strips 451 of the second circuit board 45 and formed with a second insertion hole 462 for insertion of the respective second conductive strips 451 of the second circuit board 45.

Each of the connecting terminals 5 is mounted on a respective one of the protective jackets 46 of the wire connection base 4. Preferably, each of the connecting terminals 5 has a side formed with a locking slot 51, and each of the protective jackets 46 of the wire connection base 4 has a side formed with a locking hook 463 locked in the locking slot 51 of the respective connecting terminal 5, so that each of the connecting terminals 5 is combined with the respective protective jacket 46 of the wire connection base 4. Each of the connecting terminals 5 has an inside formed with a first mounting hole 52 and a second mounting hole 53.

Each of the electric wires 6 is extended through a respective one of the support tubes 3 and has an end attached to a respective one of the connecting terminals 5.

Figure 5:
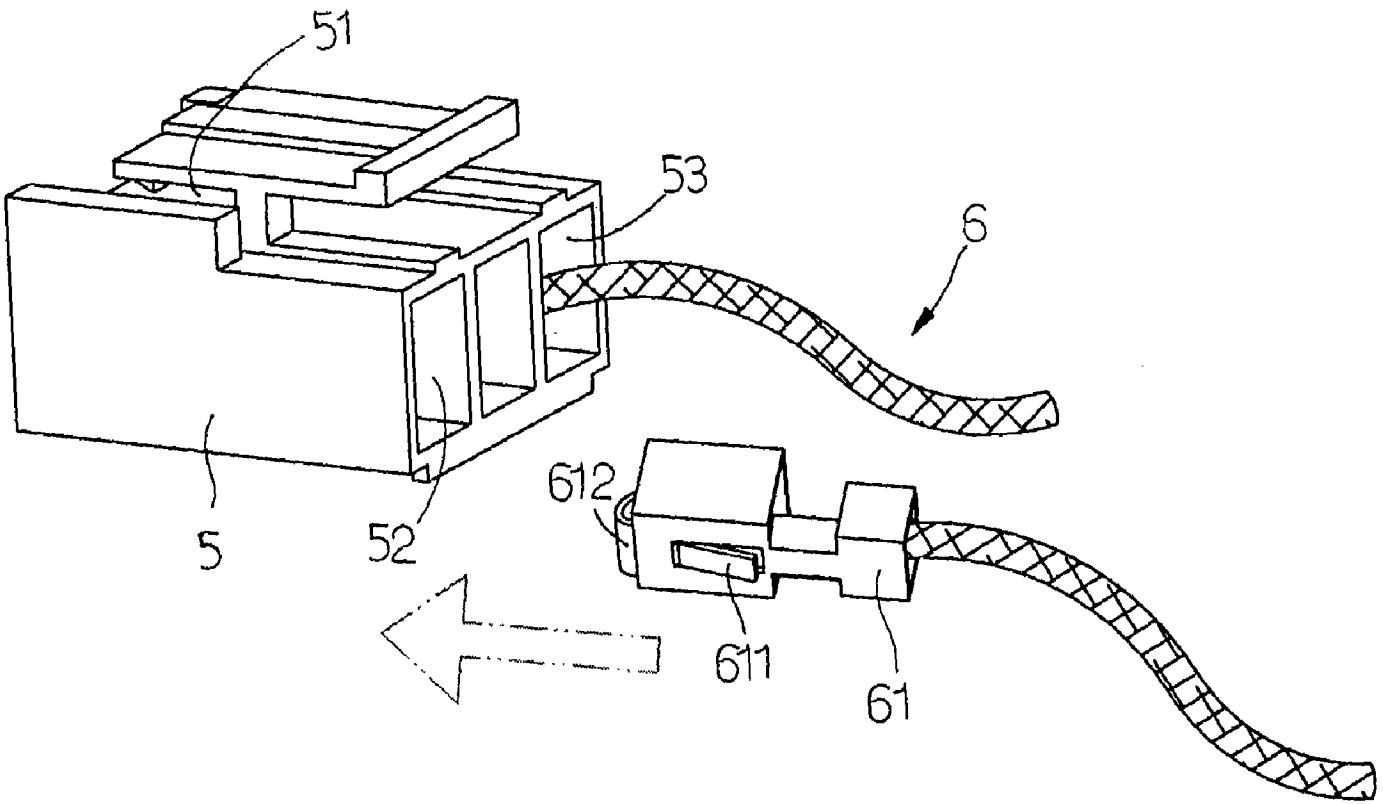
FIG. 5 is a partially perspective assembly view of the wire connection base of the suspension lamp as shown in FIG. 4.
Figure 6:
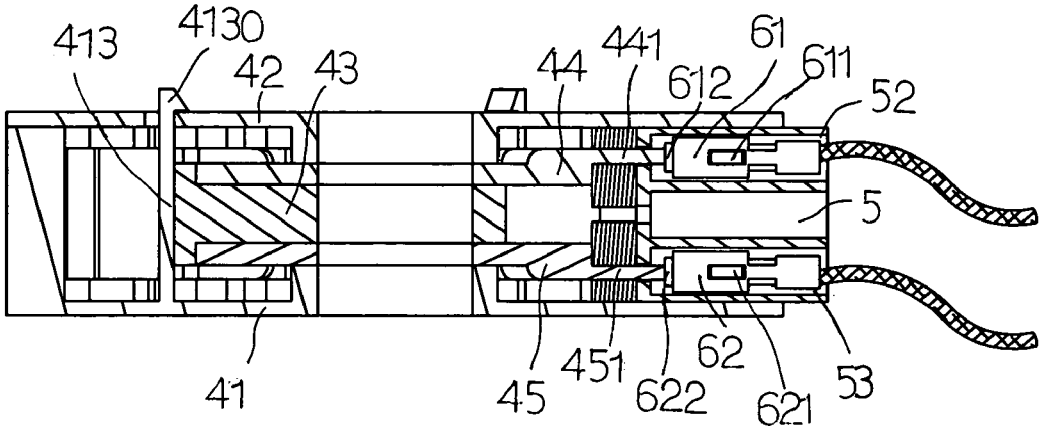
FIG. 6 is a plan cross-sectional assembly view of the wire connection base of the suspension lamp as shown in FIG. 4.
Figure 7:
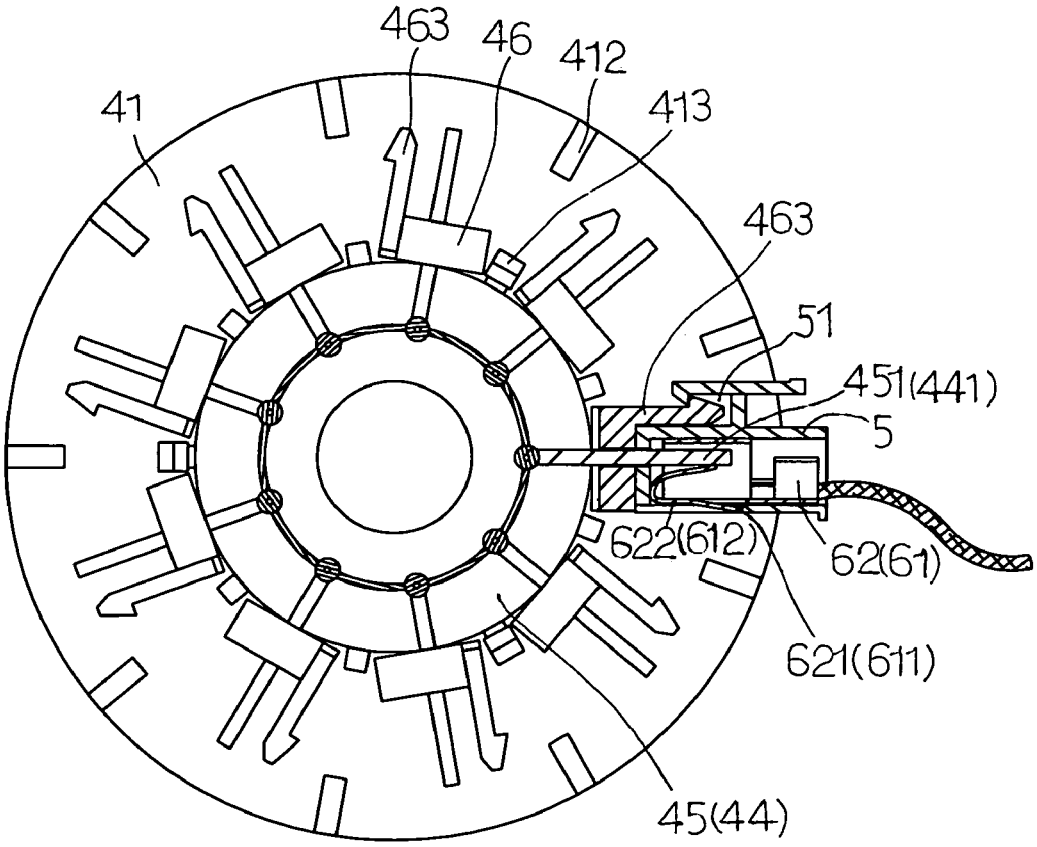
FIG. 7 is a top plan cross-sectional assembly view of the wire connection base of the suspension lamp as shown in FIG. 4.
Figure 8:
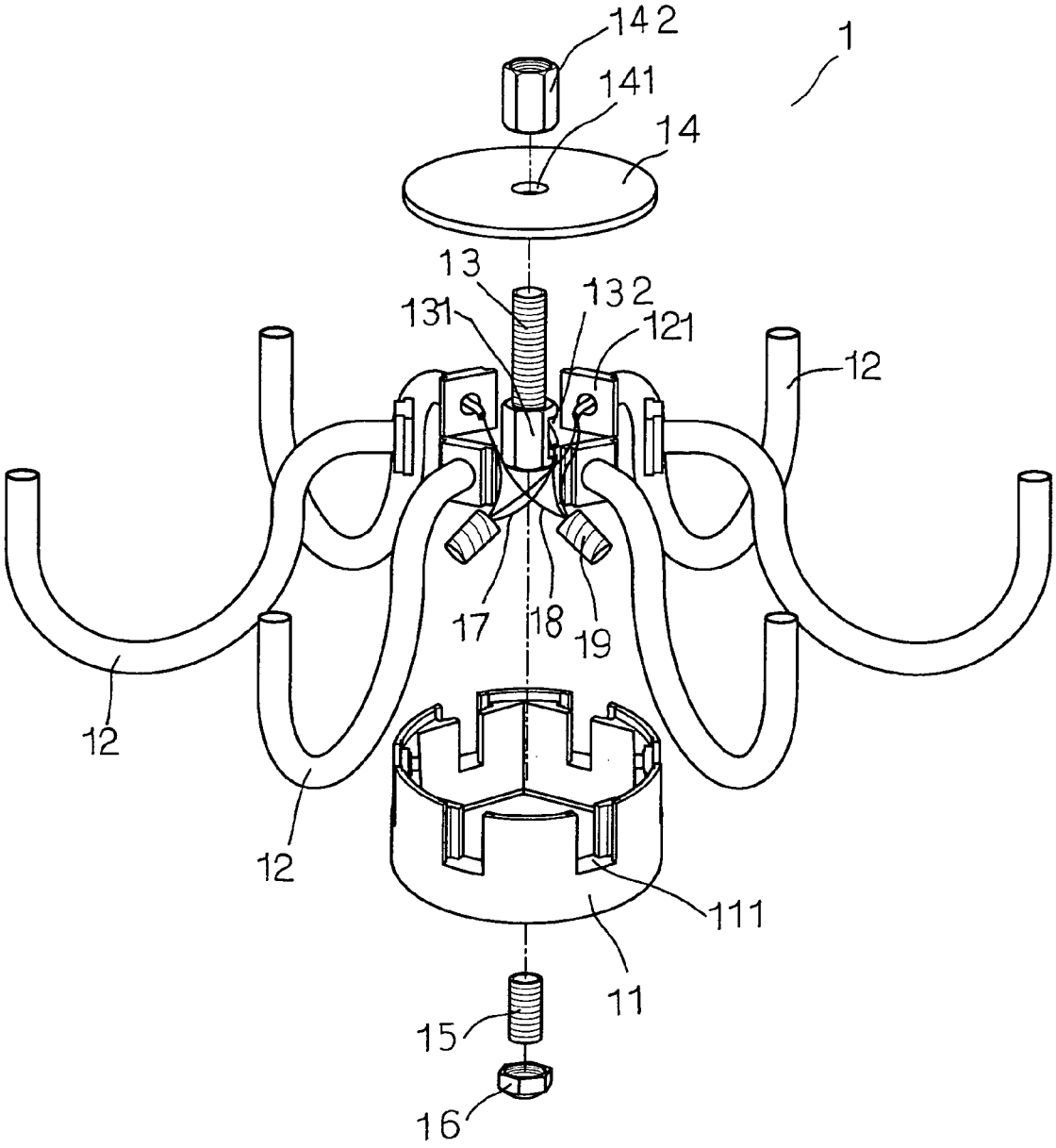
FIG. 8 is an exploded perspective view of a conventional suspension lamp in accordance with the prior art.

As shown in FIGS. 5–7, each of the electric wires 6 has a positive pole formed with a first plug 61 inserted into the first mounting hole 52 of the respective connecting terminal 5 and provided with a first contact 612 electrically connected to a respective one of the first conductive strips 441 of the first circuit board 44. The first plug 61 of each of the electric wires 6 has a side provided with a hook-shaped elastic plate 611 snapped into and locked in the first mounting hole 52 of the respective connecting terminal 5.

In addition, each of the electric wires 6 has a negative pole formed with a second plug 62 inserted into the second mounting hole 53 of the respective connecting terminal 5 and provided with a second contact 622 electrically connected to a respective one of the second conductive strips 451 of the second circuit board 45. The second plug 62 of each of the electric wires 6 has a side provided with a hook-shaped elastic plate 621 snapped into and locked in the second mounting hole 53 of the respective connecting terminal 5.

The power supply wire 7 is extended through the threaded rod 22 and the opening 222 and has a distal end provided with a connector 71 inserted into and electrically connected to either one of the protective jackets 46 of the wire connection base 4. In practice, the power supply wire 7 has a positive pole electrically connected to a respective one of the first conductive strips 441 of the first circuit board 44 through the connector 71 and the respective protective jacket 46 of the wire connection base 4 and a negative pole electrically connected to a respective one of the second conductive strips 451 of the second circuit board 45 through the connector 71 and the respective protective jacket 46 of the wire connection base 4.

In assembly, the first circuit board 44 is mounted on the first side of the spacer 43 and the second circuit board 45 is mounted on the second side of the spacer 43. Then, each of the protective jackets 46 is combined with the first circuit board 44 and the second circuit board 45, with each of the first conductive strips 441 of the first circuit board 44 being inserted into the first insertion hole 461 of the respective protective jacket 46 of the wire connection base 4, and with each of the second conductive strips 451 of the second circuit board 45 being inserted into the second insertion hole 462 of the respective protective jacket 46 of the wire connection base 4.

Figure 3:
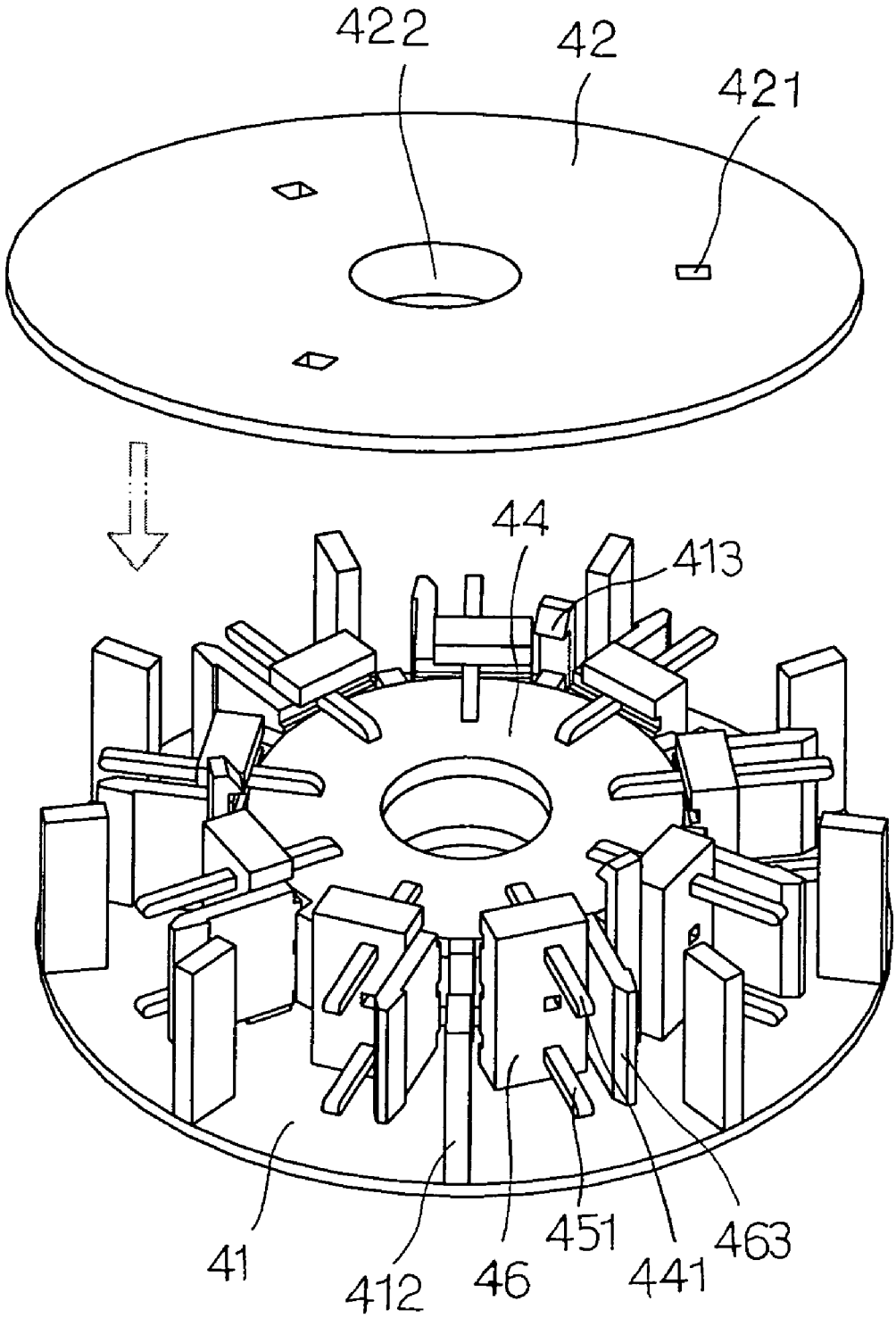
FIG. 3 is a partially perspective assembly view of a wire connection base of the suspension lamp in accordance with the preferred embodiment of the present invention.
Figure 4:
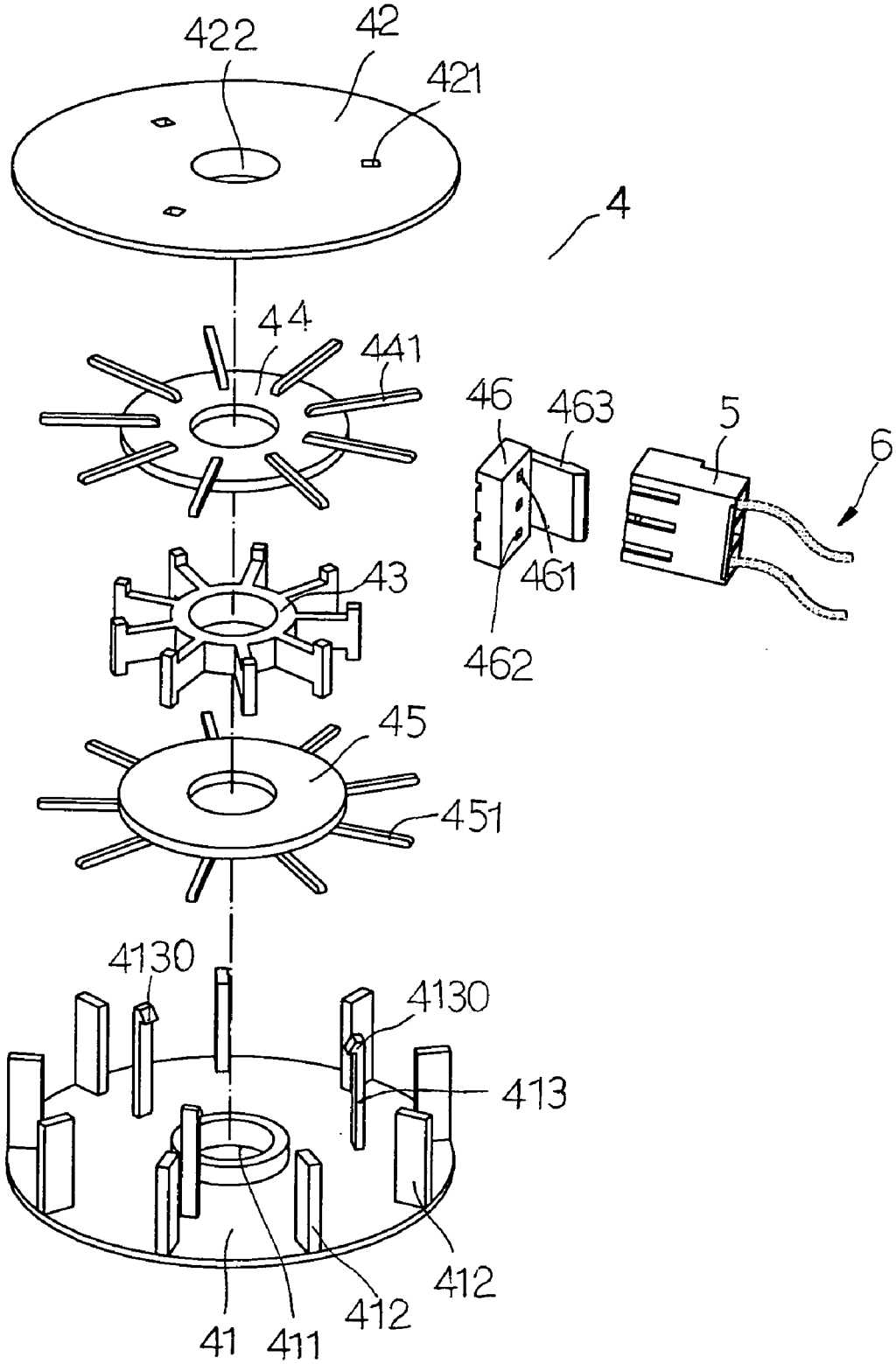
FIG. 4 is an exploded perspective view of the wire connection base of the suspension lamp in accordance with the preferred embodiment of the present invention.

Then, the combined first circuit board 44, spacer 43 and second circuit board 45 are mounted on the support seat 41 as shown in FIG. 3, and the cap 42 is mounted on the support posts 412 of the support seat 41, thereby forming the wire connection base 4 as shown in FIG. 4. Then, the wire connection base 4 is mounted in the switch box 2.

Then, the power supply wire 7 is extended through the threaded rod 22 and protruded outward from the opening 222, with the connector 71 being extended into the switch box 2. Then, the connector 71 of the power supply wire 7 is inserted into and electrically connected to either one of the protective jackets 46 of the wire connection base 4, so that the positive pole of the power supply wire 7 is electrically connected to a respective one of the first conductive strips 441 of the first circuit board 44 through the connector 71 and the respective protective jacket 46 of the wire connection base 4 and the negative pole of the power supply wire 7 is electrically connected to a respective one of the second conductive strips 451 of the second circuit board 45 through the connector 71 and the respective protective jacket 46 of the wire connection base 4.

At this time, the first conductive strips 441 are electrically connected with each other and the second conductive strips 451 are electrically connected with each other as shown in FIG. 7, so that the positive pole of the power supply wire 7 is electrically connected to all of the first conductive strips 441 of the first circuit board 44 and the negative pole of the power supply wire 7 is electrically connected to all of the second conductive strips 451 of the second circuit board 45 to form an electrical connection state.

Then, the connector 31 of each of the support tubes 3 is locked in a respective one of the locking grooves 21 of the switch box 2. Then, each of the electric wires 6 is extended through a respective one of the support tubes 3. At this time, the first plug 61 of each of the electric wires 6 is inserted into the first mounting hole 52 of the respective connecting terminal 5 and the second plug 62 of each of the electric wires 6 is inserted into the second mounting hole 53 of the respective connecting terminal 5.

Then, each of the connecting terminals 5 is mounted on a respective one of the protective jackets 46 of the wire connection base 4, so that the first contact 612 of the first plug 61 of each of the electric wires 6 is electrically connected to a respective one of the first conductive strips 441 of the first circuit board 44 and the second contact 622 of the second plug 62 of each of the electric wires 6 is electrically connected to a respective one of the second conductive strips 451 of the second circuit board 45 so as to form an electrical connection state.

Finally, the upper cover 23 is mounted on the opened top of the switch box 2 and is combined with the threaded rod 22 by the nut 232, and the threaded rod 22 is combined with the screw 24 by the nut 25, thereby assembling the suspension lamp as shown in FIG. 1.

Accordingly, the operator only needs to mount each of the connecting terminals 5 on a respective one of the protective jackets 46 of the wire connection base 4 so as to form an electrical connection state, so that the electric circuit of the suspension lamp is connected easily and conveniently, thereby facilitating the operator mounting the electric circuit of the suspension lamp.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A suspension lamp, comprising:

a switch box;

a wire connection base mounted in the switch box and including a support seat mounted on the switch box, a cap mounted on the support seat, a spacer mounted on the support seat and located between the support seat and the cap, a first circuit board mounted on a first side of the spacer and located between the spacer and the cap, a second circuit board mounted on a second side of the spacer and located between the spacer and the support seat, and a plurality of protective jackets each combined with the first circuit board and the second circuit board;

a plurality of connecting terminals each mounted on a respective one of the protective jackets of the wire connection base; and a plurality of electric wires each having an end attached to a respective one of the connecting terminals and each electrically connected to the first circuit board and the second circuit board through the respective connecting terminal and the respective protective jacket.

2. The suspension lamp in accordance with claim 1, wherein the support seat of the wire connection base has a periphery provided with a plurality of support posts each rested on the cap.

3. The suspension lamp in accordance with claim 1, wherein the cap of the wire connection base is formed with a plurality of locking holes, and the support seat of the wire connection base is formed with a plurality of locking posts each having an end formed with a locking hook locked in a respective one of the locking holes of the cap, so that the cap is combined with the support seat.

4. The suspension lamp in accordance with claim 1, wherein each of the connecting terminals has a side formed with a locking slot, and each of the protective jackets of the wire connection base has a side formed with a locking hook locked in the locking slot of the respective connecting terminal, so that each of the connecting terminals is combined with the respective protective jacket of the wire connection base.

5. The suspension lamp in accordance with claim 1, wherein the first circuit board of the wire connection base has a periphery provided with a plurality of first conductive strips electrically connected with each other, and the second circuit board of the wire connection base has a periphery provided with a plurality of second conductive strips electrically connected with each other.

6. The suspension lamp in accordance with claim 5, wherein each of the protective jackets of the wire connection base has a first end mounted on a respective one of the first conductive strips of the first circuit board and formed with a first insertion hole for insertion of the respective first conductive strip of the first circuit board, and each of the protective jackets of the wire connection base has a second end mounted on a respective one of the second conductive strips of the second circuit board and formed with a second insertion hole for insertion of the respective second conductive strips of the second circuit board.

7. The suspension lamp in accordance with claim 5, wherein each of the connecting terminals has an inside formed with a first mounting hole and a second mounting hole, each of the electric wires has a positive pole formed with a first plug inserted into the first mounting hole of the respective connecting terminal and provided with a first contact electrically connected to a respective one of the first conductive strips of the first circuit board, and each of the electric wires has a negative pole formed with a second plug inserted into the second mounting hole of the respective connecting terminal and provided with a second contact electrically connected to a respective one of the second conductive strips of the second circuit board.

8. The suspension lamp in accordance with claim 7, wherein the first plug of each of the electric wires has a side provided with a hook-shaped elastic plate snapped into and locked in the first mounting hole of the respective connecting terminal.

9. The suspension lamp in accordance with claim 7, wherein the second plug of each of the electric wires has a side provided with a hook-shaped elastic plate snapped into and locked in the second mounting hole of the respective connecting terminal.

10. The suspension lamp in accordance with claim 5, further comprising a power supply wire having a distal end provided with a connector inserted into and electrically connected to either one of the protective jackets of the wire connection base.

11. The suspension lamp in accordance with claim 10, wherein the power supply wire has a positive pole electrically connected to a respective one of the first conductive strips of the first circuit board through the connector and the respective protective jacket of the wire connection base and a negative pole electrically connected to a respective one of the second conductive strips of the second circuit board through the connector and the respective protective jacket of the wire connection base.

* * * * *